US006355402B1

(12) United States Patent
Ahn

(10) Patent No.: US 6,355,402 B1
(45) Date of Patent: Mar. 12, 2002

(54) ELECTRODES IN PLASMA DISPLAY PANEL AND MANUFACTURING METHOD THEREOF

(75) Inventor: Sung-il Ahn, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/712,174

(22) Filed: Nov. 15, 2000

(30) Foreign Application Priority Data

Nov. 15, 1999 (KR) ..... 99-50592

(51) Int. Cl.[7] ..... H01J 9/02

(52) U.S. Cl. ..... 430/319; 430/318; 430/321; 445/24; 445/49; 313/582; 313/584

(58) Field of Search ..... 430/319, 318, 430/330, 321, 325; 445/24, 49; 313/584, 582

(56) References Cited

U.S. PATENT DOCUMENTS 6,156,433 A * 12/2000 Hatori et al. ..... 428/411.1

FOREIGN PATENT DOCUMENTS

JP 11-144610 A * 5/1999
JP 11-224531 A * 8/1999

* cited by examiner

*Primary Examiner*—John A. McPherson
(74) *Attorney, Agent, or Firm*—Leydig, Voit, & Mayer, Ltd.

(57) ABSTRACT

Electrodes in a plasma display panel are manufactured by (A) forming a pattern for electrodes on a substrate to be wider than a desired pattern, (B) coating photoresist on the electrode pattern, (C) disposing a photomask having the desired pattern on the photoresist and exposing the photoresist, and (D) forming electrodes having the desired pattern by developing and baking the exposed electrode pattern by using the photomask. Thus, the cost for a material for electrodes can be reduced, and short circuiting between the electrodes and the edge curl phenomenon can be prevented.

9 Claims, 5 Drawing Sheets

ELECTRODES IN PLASMA DISPLAY PANEL AND MANUFACTURING METHOD THEREOF

BACKGROUND OF THE INVENTION

1. Field of the Invention

The present invention relates to a plasma display panel and a manufacturing method thereof, and more particularly, to electrodes in a plasma display panel which can reduce the cost of a material used for electrodes and prevent short circuiting between the electrodes, and a manufacturing method thereof.

2. Description of the Related Art

A typical plasma display panel is filled with a gas which is sealed inside the panel between two substrates where a plurality of electrodes are coated. When a discharge voltage is applied, ultraviolet rays are emitted due to the discharge voltage so that fluorescent substance formed in a predetermined pattern is excited to form numbers, characters, or graphics.

Plasma display panels can be classified as a DC (direct current) type or an AC (alternating current) type according to the type of a driving voltage applied to a discharge cell. Also, plasma display panels can be classified as a facing electrode type or a surface discharge type according to the configuration of electrodes. The DC type plasma display panel has electrodes which are all exposed to a discharge space, in which charged particles directly move between the corresponding electrodes. In the AC type plasma display panel, at least one electrode is enclosed by a dielectric layer, and a discharge is produced by an electric field of wall charges instead of charged particles directly moving between the corresponding electrodes.

FIGS. 1 and 2 show the structure of a typical AC type plasma display panel. Referring to the drawings, in a typical plasma display panel, a plurality of electrodes 11 are formed in a predetermined pattern on the upper surface of a rear substrate 10. A dielectric layer 12 is formed on the rear substrate 10 where the first electrodes 11 are formed. Barrier ribs 13 for maintaining a discharge distance and preventing cross talk between discharge cells is formed on the upper surface of the dielectric layer 12. A plurality of second electrodes 14 and a plurality of third electrodes 15 are formed on the lower surface of a front substrate 16 in predetermined patterns to cross the first electrodes 11. The front substrate 16 is coupled to the rear substrate 10 where the barrier ribs 13 are located. The second and third electrodes 14 and 15 are transparent electrodes and a plurality of bus electrodes 17 for reducing line resistance of the second and third electrodes 14 and 15 are formed on the lower surface of each of the second and third electrodes 14 and 15, such that each of the bus electrodes 17 has a width narrower than that of each of the transparent electrodes. A dielectric layer 19 is formed on the lower surface of the front substrate 16 where electrodes 14, 15, and 17 are formed. A fluorescent layer 18 is formed at at least one surface of discharge spaces defined by the barrier ribs 13.

In the plasma display panel, the bus electrodes 17 are of metal to reduce the line resistance of the transparent second and third electrodes 14 and 15. Thus, in order to minimize blocking of light emitted from the fluorescent layer 18, the bus electrodes 17 are located at an edge of each of the second and third electrodes 14 and 15 to have a width as narrow as possible.

The bus electrodes 17 are formed using a printing method using a metal material for example, silver (Ag) paste, a photolithography method using a photosensitive film, or a vapor deposition method.

The printing method is most advantageous in that the paste is cheap and the amount of the paste needed is small, i.e., ⅓through ¼less than the other methods. However, the width of the electrode line is limited to 60 through 70 $\mu$m, so that forming accurate lines is difficult.

In the vapor deposition method, compared to the photolithography, the cost for a material is low and forming accurate lines is possible. However, the defective rate in an etching process is high and a high initial investment is needed.

In the photolithography method, the cost for an electrode pastes is high, and since a pattern is formed with only selected portions through an exposing process after printing the overall surface, the material is wasted. However, once a production line is set, the photolithography method is a very stable process and forming accurate electrode lines is possible.

FIGS. 3A through 3E show a method of forming the bus electrodes on the transparent electrodes using the photolithography method. Electrode paste 170 is applied to the overall surface of a glass substrate 16 where transparent electrodes 14 and 15 are formed by spin coating (FIG. 3A). Photoresist 22 is applied to the electrode paste 10 (FIG. 3B). A photomask 23 is placed on the photoresist 22 and the upper portion of the photoresist 22 is exposed to light (FIG. 3C). Then, the exposed electrode paste 17 is developed and baked so that bus electrodes 17 are completed (FIGS. 3D and 3E).

Here, an edge curl phenomenon in which portion of an electrode pattern is lifted is problematic in the photolithography method. FIG. 4 shows such an edge curl phenomenon, that is, both edges of one of the bus electrodes 17 are lifted. The lifting of the edge is known to be generated due to a difference in the compression rate between both edges and the middle portion of a bus electrode. The edge curl problem is described in a Japanese monthly magazine, "FPD Intelligence", at page 45, May 1998 and page 60, November 1998. When the edge curl is generated, contact area between the bus electrodes and transparent electrodes is reduced so that contact resistance increases. Also, the height of the bus electrode increases due to the lifting thereof so that a dielectric layer becomes thin.

In addition, another problem in the photolithography method is short circuit between the electrodes. The short circuit occurs between the electrodes during the exposing process by intrusion of impurities in the paste where electrodes are present. The short circuit may cause a defective panel, and also damage a circuit so that the plasma display panel cannot even be repaired.

SUMMARY OF THE INVENTION

To solve the above problems, it is an objective of the present invention to provide electrodes in a plasma display panel which can save the cost for a material for electrodes, and prevent short circuit between the electrodes and the edge curl phenomenon, and a manufacturing method thereof.

Accordingly, to achieve the above objective, there is provided a method of manufacturing electrodes in a plasma display panel, which comprises the steps of (A) forming a pattern for electrodes on a substrate to be wider than a desired pattern, (B) coating photoresist on the electrode pattern, (C) disposing a photomask having the desired pattern on the photoresist and exposing the photoresist, and (D) forming electrodes having the desired pattern by developing and baking the exposed electrode pattern by using the photomask.

It is preferred in the present invention that the electrode pattern in step (A) is formed by a print method.

Also, it is preferred in the present invention that the electrode pattern is formed of silver (Ag).

Also, it is preferred in the present invention that the electrode pattern has a bulged middle portion and thin edge portions.

Also, to achieve the above objective, there is provided electrodes in a plasma display panel which are formed by forming a pattern of electrodes on a substrate to be wider than a desired pattern, coating photoresist on the electrode pattern, disposing a photomask having the desired pattern on the photoresist and exposing the photoresist, and forming electrodes having the desired pattern by developing and baking a pattern of electrodes exposed by the photomask.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
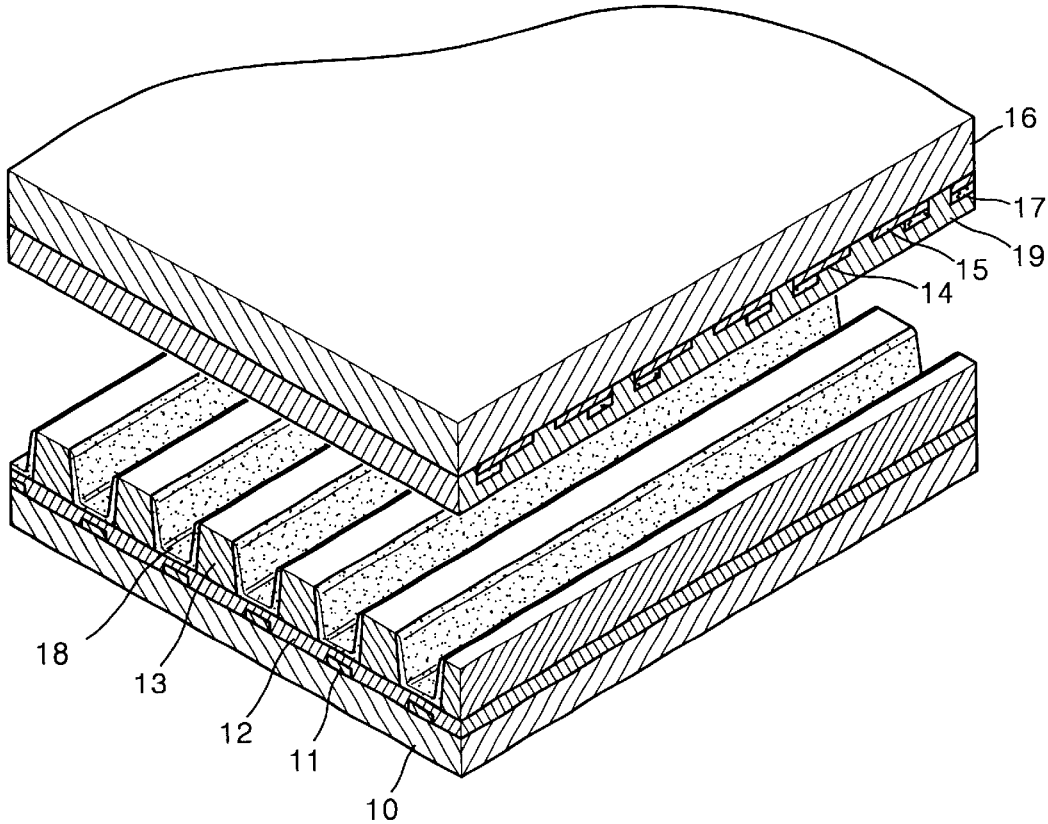
FIG. 1 (PRIOR ART)
FIG. 1 is an exploded perspective view showing a typical AC type plasma display panel.
Figure 2:
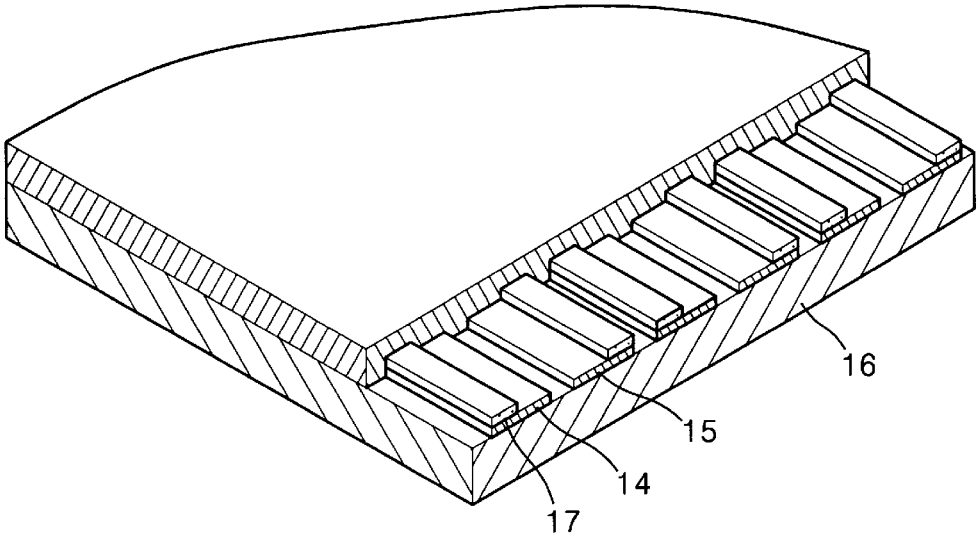
FIG. 2 (PRIOR ART)
FIG. 2 is a perspective view showing the bus electrodes located on the transparent electrodes of FIG. 1.
Figure 3A:
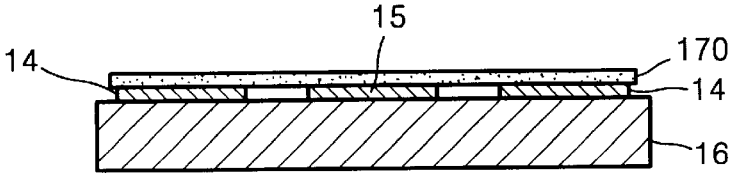
FIG. 3A (PRIOR ART)
FIGS. 3A through 3E are views showing the conventional method of manufacturing the bus electrodes in a plasma display panel.
Figure 3B:
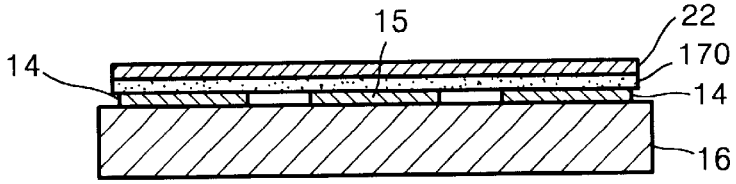
FIG. 3B (PRIOR ART)
Figure 3C:
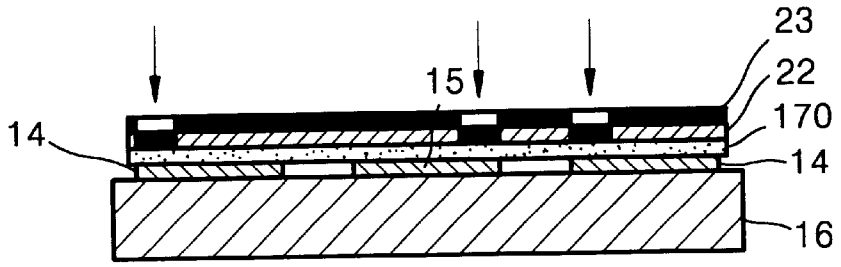
FIG. 3C (PRIOR ART)
Figure 3D:
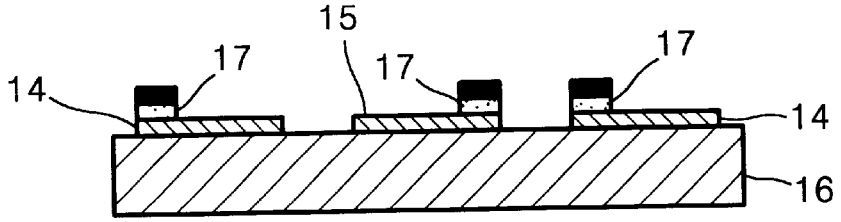
FIG. 3D (PRIOR ART)
Figure 3E:
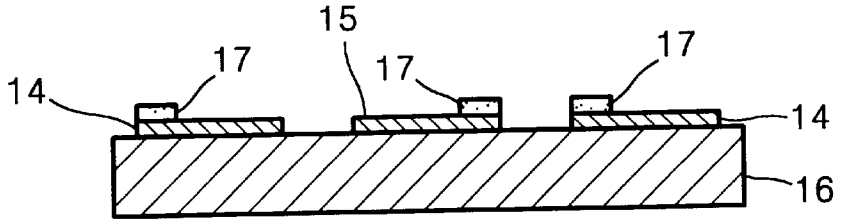
FIG. 3E (PRIOR ART)
Figure 4:
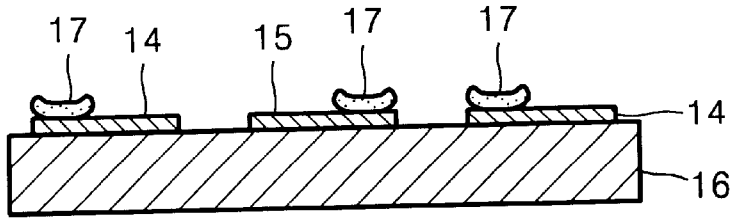
FIG. 4 (PRIOR ART)
FIG. 4 is a view showing the edge curl phenomenon.
Figure 5A:
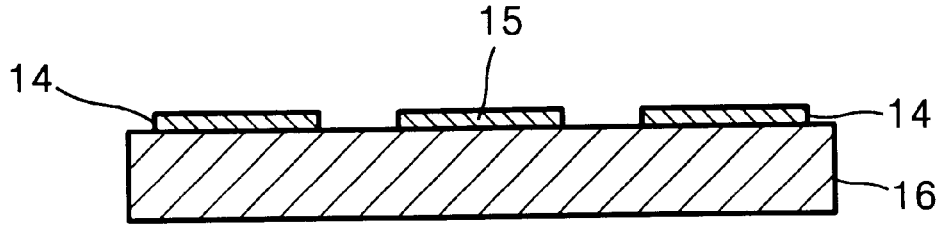
FIGS. 5A through 5F are views showing a method of manufacturing electrodes in a plasma display panel according to a preferred embodiment of the present invention.
Figure 5B:
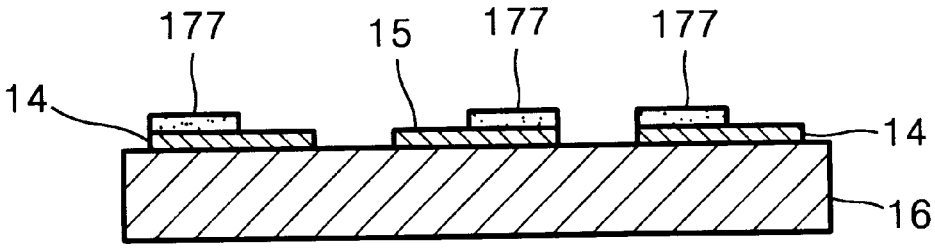
Figure 5C:
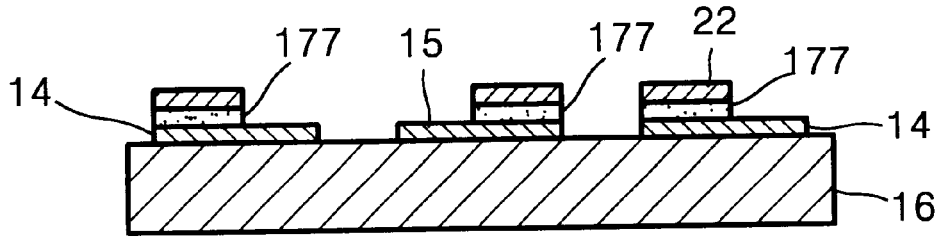
Figure 5D:
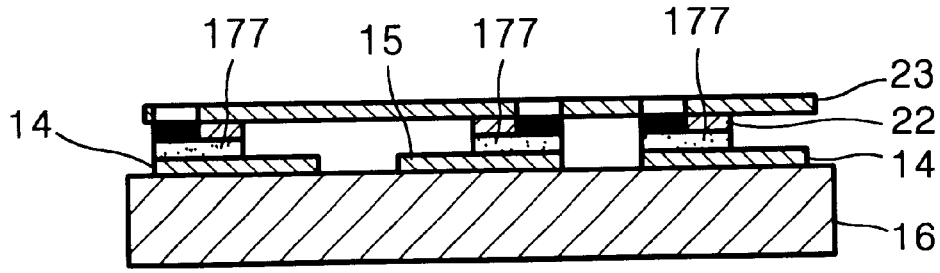
Figure 5E:
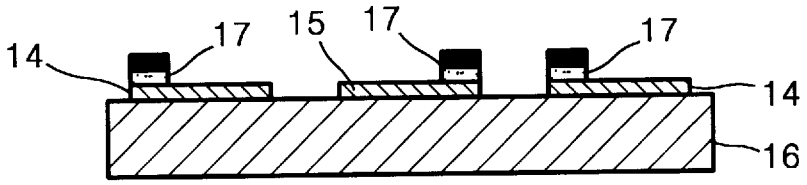
Figure 5F:
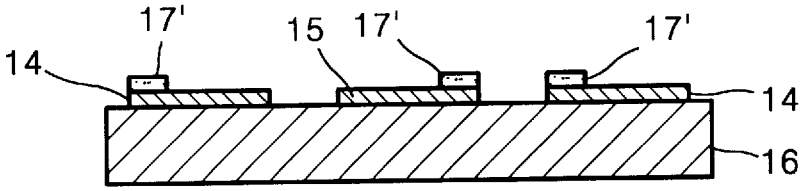

Referring to FIGS. 5A through 5F, to manufacture electrodes in a plasma display panel according to a preferred embodiment of the present invention, a plurality of first electrodes 14 and a plurality of second electrodes 15 are formed on a glass substrate 16 (FIG. 5A). Preferably, the first and second electrodes 14 and 15 are ITO (indium tin oxide) transparent electrodes. Next, a pattern 177 for bus electrode is formed on each of the first and second electrodes 14 and 15 wider than a desired pattern (FIG. 5B). Preferably, the bus electrode pattern 177 is formed by a printing method, and the width of the bus electrode pattern 177 is within a range of 150–250 $\mu$m. Further, the bus electrode pattern 177 is preferably formed of silver (Ag). Next, photolithography is performed with respect to the bus electrode pattern 177. That is, photoresist 22 is applied to the bus electrode pattern 177 (FIG. 5C). A photomask 23 having the same pattern as that of the desired bus electrodes is disposed on the photoresist 22 and then exposed (FIG. 5D). Bus electrodes 17" having a desired pattern are finely formed by developing and baking the exposed bus electrode pattern 17 (FIGS. 5E and 5F). Here, although a negative method is used, viewed from the drawings, a positive method can be used.

When a bus electrode pattern is formed by the printing method, the bus electrodes pattern has a bulged middle portion and thin edge portions. Thus, when fine bus electrodes are finely formed by the photolithography method with respect to the bus electrode pattern having the above shape, the edge curl phenomenon in which the edge portions of the electrode are lifted is not generated.

Figure 6A:
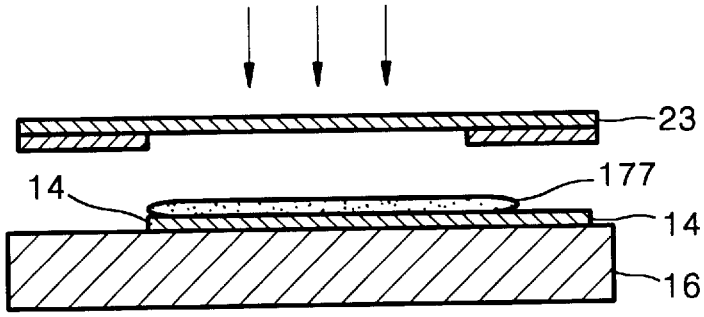
FIGS. 6A and 6B are views showing the shape of an electrode in a plasma display panel according to the present invention.
Figure 6B:
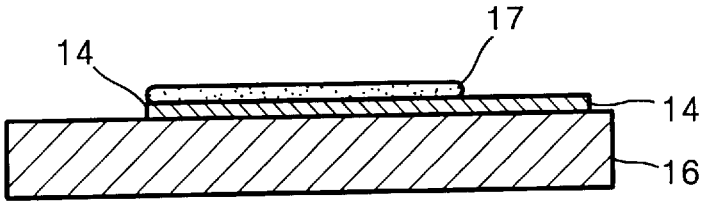

That is, unlike the convention technology, in the present invention, the bus electrode pattern formed by the printing method has, as shown in FIG. 6A, a bulged middle portion and thin edge portions. Since the photolithography method is performed with respect to such an electrode pattern, even when a difference in compression rate exists between the middle portion and the edge portions of the bus electrode pattern, such a difference in compression rate can be compensated for by the electrode pattern having the above shape. That is, when the edge portions of the bus electrode pattern formed by the photolithography method are lifted due to a difference in compression rate between the middle portion and the edge portions, the edge portions and the middle portion can have the nearly same height since the edge portions are thinner than the middle portion. Thus, a bus electrode 17 having the shape as shown in FIG. 6B is formed so that the edge curl phenomenon does not occur.

Also, according to the present invention, the material used for the electrode paste can be remarkably reduced. That is, compared with the conventional as print method in which printing is performed over the entire surface, according to the pattern printing of the present invention, a pattern is primarily performed by the printing method, and then, the photolithography method is performed. Thus, since there is no need to print over the entire surface, the material for the electrode paste needed is reduced by ⅕through ⅓compared with the conventional method.

Also, since a pattern is produced by the printing method and then fine electrode lines are formed by the photolithography method, a short circuit between the electrodes generated by the intrusion of impurities while the photolithography method is performed can be prevented.

It is noted that the present invention is not limited to the preferred embodiment described above, and it is apparent that variations and modifications by those skilled in the art can be effected within the spirit and scope of the present invention defined in the appended claims.

What is claimed is:

1. A method of manufacturing electrodes of a plasma display panel comprising:

(A) forming a pattern for electrodes on a substrate wider than a desired pattern;

(B) applying a coating of photoresist to the pattern for electrodes;

(C) disposing a photomask having the desired pattern on the photoresist and exposing the photoresist through the photomask; and (D) forming electrodes having the desired pattern by developing and baking the electrode pattern exposed using the photomask.

2. The method as claimed in claim 1, including forming the pattern for electrodes by printing.

3. The method as claimed in claim 2, including forming the electrode pattern of silver.

4. The method as claimed in claim 2, wherein the electrode pattern has a bulged middle portion and thin edge portions.

5. Electrodes of a plasma display panel formed by forming a pattern of electrodes on a substrate wider than a desired pattern, applying photoresist to the pattern for electrodes, disposing a photomask having the desired pattern on the photoresist and exposing the photoresist through the photomask, and forming electrodes having the desired pattern by developing and baking the electrode pattern exposed using the photomask.

6. A method of manufacturing electrodes of a plasma display panel comprising:

(A) forming a plurality of transparent first electrodes and a plurality of transparent second electrodes on a substrate;

(B) forming a pattern for bus electrodes on each of the first and second electrodes wider than a desired pattern;

(C) applying a coating of photoresist to the bus electrode pattern;

(D) disposing a photomask having the same pattern as that of the desired pattern on the photoresist and exposing the photoresist through the photomask; and (E) forming bus electrodes having the desired pattern by developing and baking the bus electrode pattern exposed using the photomask.

7. The method as claimed in claim 6, including forming the pattern for bus electrodes by printing.

8. The method as claimed in claim 6, wherein the bus electrode pattern has a bulged middle portion and thin edge portions.

9. The method as claimed in claim 6, wherein the width of the bus electrode pattern is within a range of 150–250 $\mu$m.

* * * * *